US005581805A

United States Patent [19]

Rennick

[11] Patent Number: 5,581,805

[45] Date of Patent: Dec. 10, 1996

[54] PROTECTIVE BODY PAD

[76] Inventor: Mark Rennick, 3011 Greyfield Trace, SE., Marietta, Ga. 30067

[21] Appl. No.: 517,745

[22] Filed: Aug. 22, 1995

[51] Int. Cl.[6] ..... A41D 13/00

[52] U.S. Cl. ..... 2/2; 2/22

[58] Field of Search ..... 2/2, 16, 22, 23, 2/24

[56] References Cited

U.S. PATENT DOCUMENTS

| | | | |
|---|---|---|---|
| 588,907 | 8/1897 | Herbelin . | |
| 1,351,731 | 9/1920 | Baldwin | 2/16 |
| 1,577,540 | 3/1926 | Punches . | |
| 4,484,361 | 11/1984 | Leighton et al. | 2/24 |
| 4,580,297 | 4/1986 | Maejima | 2/22 |
| 4,599,747 | 7/1986 | Robinson | 2/24 X |
| 5,373,584 | 12/1994 | Parcells, III | 2/24 X |
| 5,384,913 | 1/1995 | Hendry | 2/22 X |
| 5,459,878 | 10/1995 | Gold | 2/23 X |

FOREIGN PATENT DOCUMENTS

| | | | |
|---|---|---|---|
| 651292 | 4/1992 | Australia | 2/2 |

*Primary Examiner*—Paul C. Lewis

*Attorney, Agent, or Firm*—Flynn, Thiel, Boutell & Tanis, P.C.

[57] ABSTRACT

A protective body pad (10) for lessening injury to knees, elbows and other body parts as a result of exposure to either repetitive or sudden impact forces. The protective body pad of this invention includes a shell (14) with straps (16, 18) that is secured to the body part to be protected. A cushion sub-assembly (12) is disposed inside the shell. The cushion-sub assembly includes a first, outer cushion (22) formed of relatively incompressible material and a second, inner cushion (24) formed of more compressible material that is attached to the outer cushion and positioned to be located adjacent the body surface. Metal caps (20) are attached to the outer surface of the shell to absorb and deflect impact forces.

22 Claims, 7 Drawing Sheets

PROTECTIVE BODY PAD

FIELD OF THE INVENTION

This invention relates generally to a protective body pad assembly and, more particularly, to a protective body pad assembly that both minimizes the injury that can result from exposure to physical body shock and that is comfortable to wear.

BACKGROUND OF THE INVENTION

Protective body pads are often worn on the knees, elbows and hands of individuals who engage in activities that can expose these body parts to either repetitive shock or significant physical shock. Knee pads, for example, are worn by individuals such as carpenters and roofers who spend a significant amount of their working days with their knees pressed against an underlying support surface. Knee pads, elbow pads, and sometimes hand pads, are worn by individuals who engage in recreational activities such as roller skating or hockey. In these sports, the protection provided by these pads lessens the likelihood that an individual will be significantly injured if he/she is either struck during the activity or falls against a hard surface. A typical protective body pad includes a body formed of cushioning foam that is encased in a shell that is strapped around the limb of the individual. Often, a strip of leather or other relatively resilient material is secured to the outer face of the shell that is expected to receive the most contact with external physical objects. For example, the pads intended for in-line skaters are provided with resilient members so that, when the skater falls, the resilient members are normally the first element of the pads to contact the underlying pavement.

While current protective body wear are useful for reducing the injuries associated with many physical activities, they have not proven totally useful for all of these activities. For instance, protective body wear used by many individuals during in-line skating is basically a modification of that used by individuals engaged in ice hockey and other skating activities. While this body wear is useful for cushioning some of the initial shock to which a skater is exposed to as he/she initially hits the pavement, these pads do little to lessen the effects of some of the post-impact shock. This shock occurs because, when a skater falls, he typically strikes a hard cement or asphalt pavement that does not yield to physical impact. Once the individual strikes this unyielding surface, the force of the impact can be transmitted through the limbs of the individual to cause bones to break or can cause significant soft tissue injury.

Moreover, a problem with many protective body pads is that the material from which the shell material and the outer pads are manufactured, by their inherent nature, are not very porous. These components thus form barriers that prevent perspiration from evaporating and convective air flow from passing over the skin. The inability of the perspiratory fluid to be able to evaporate away from the skin and for cooling air to flow over the skin can make these body pads uncomfortably warm to wear. Furthermore, over time, perspiratory fluids retained on the skin can accumulate. This undissipated fluid can be the source of irritation or, in more severe cases, cause skin infections. Collectively, the uncomfortable and undesirable side effects of wearing body pads causes some individuals, particularly those engaged in recreational activities, to forego their wear. Such a decision increases the likelihood that the individual engaging in these activities will injure himself.

SUMMARY OF THE INVENTION

This invention relates generally to a protective body pad that can absorb and redirect a significant amount of physical shock to which its wearer is exposed and is further designed to allow evaporation of perspiration away from the skin and air flow around the skin. More particularly, this invention is directed to a protective body pad that is formed with a cushion subassembly that is formed out of two layers of cushioning material, a shell that encases the cushion subassembly, and a set of shock absorbing and deflecting metal caps that are secured to the outer face of the shell.

The protective body pad of this invention includes a cushion sub-assembly that includes an outer cushion formed of relatively incompressible cushioning material that is contoured to fit the body part around which the protective pad is to be worn. A small inner cushion is secured to the inside surface of the outer cushion adjacent the body part that is typically the point of impact for physical shock. The inner cushion is formed of material that is more readily compressible than the material forming the outer cushion.

The cushion sub-assembly is seated inside a shell formed out of a material such as a natural or synthetical fabric that allows air and vapor flow therethrough. A number of relatively small metal caps are secured to the outer surface of the shell. These metal caps are secured to the shell along their outer perimeter portions thereof and are shaped to have an outwardly curved, convex profile. In some preferred versions of this invention, these metal caps have a circular shape.

When an individual wearing a protective body pad of this invention strikes a hard surface, such as hard pavement, the metal caps initially absorb some of the impact of the shock. Owing to the convex profile of the caps and their spaced apart arrangement, they do not cause the protective body pad to adhere to the surface. Instead, the caps allow the pad and the person wearing it to slide along the pavement. Thus, a sizeable portion of the force of the impact is dissipated into friction along the pavement-cap interfaces instead of simply being transmitted into the protective padding and into the wearer's body. The fraction of the impact force that is transmitted into the cushion sub-assembly is initially attenuated by the compression of the inner cushion. A sizeable fraction of this remaining, undamped force is then absorbed by the compression of the outer cushion. Thus, the protective body pad of this invention redistributes and absorbs the force of an impact shock so that it is not absorbed by the body where it can become the source of a hard or soft tissue injury.

Another advantage of the protective body pad of this invention is that, owing to the fastening of the metal caps to the shell around their outer perimeters, when the caps are forced against a hard surface, the force transmitted to the caps is, in turn, redistributed around the outer perimeter of the caps. The redistribution of this force prevents the caps from separating from the shell as a result of the hard surface contact.

The biasing of the large cushion away from the body of the person wearing this pad and the porous nature of the material forming the outer shell allow relatively large volumes of air to flow through the protective body pad of this invention and adjacent the skin of the person wearing the pad. This airflow fosters the evaporation of perspiration away from the skin. By allowing the perspiration to evaporate, the chance of the individual's skin becoming irritated is reduced and the skin is kept cool. Thus, the protective body pad of this invention not only reduces the risk of bodily injury, it is also relatively comfortable to wear.

BRIEF DESCRIPTION OF THE DRAWINGS

This invention is pointed out with particularity in the claims. The above and further advantages of this invention may be better understood by referring to the following description taken in conjunction with the accompanying drawings in which:

DETAILED DESCRIPTION

Figure 2:
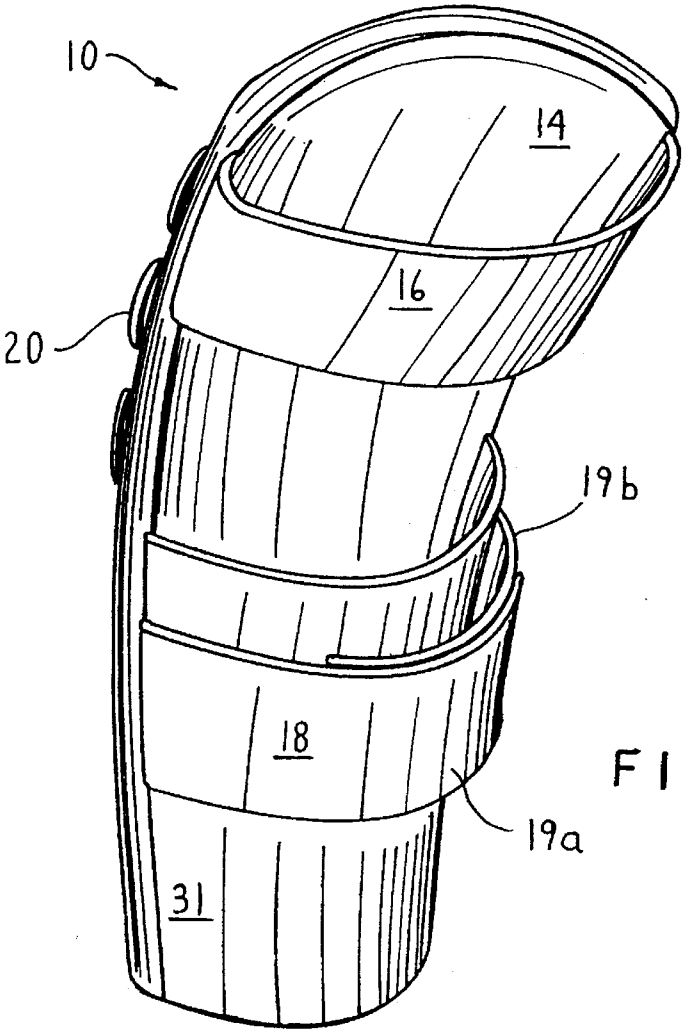
FIG. 2 is a back side perspective view of the protective body pad of FIG. 1.
Figure 1:
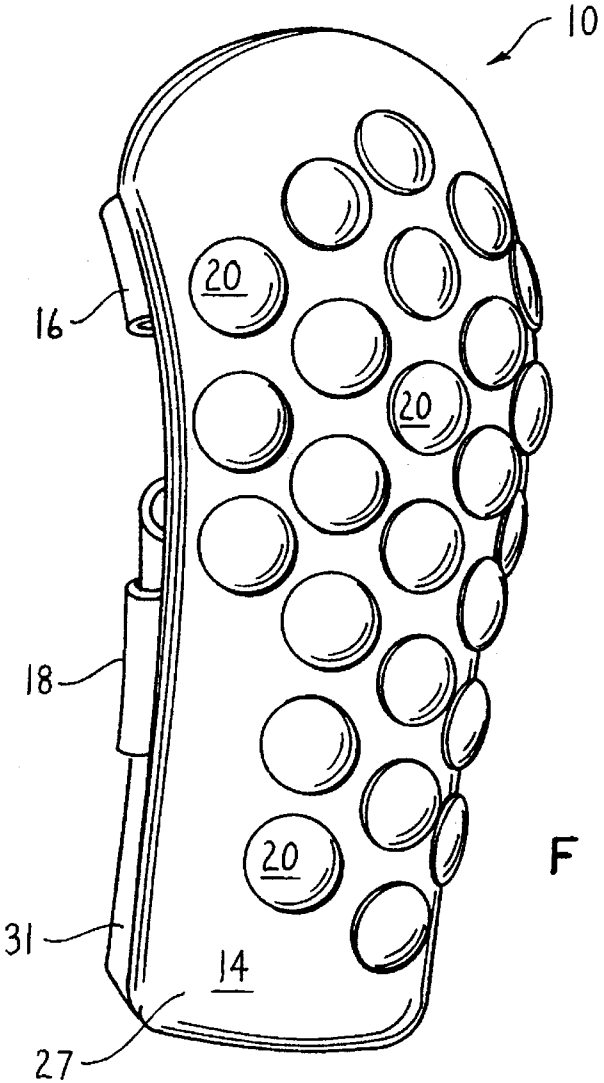
FIG. 1 is a perspective view of a protective body pad of this invention configured to be worn adjacent an individual's knee.
Figure 3:
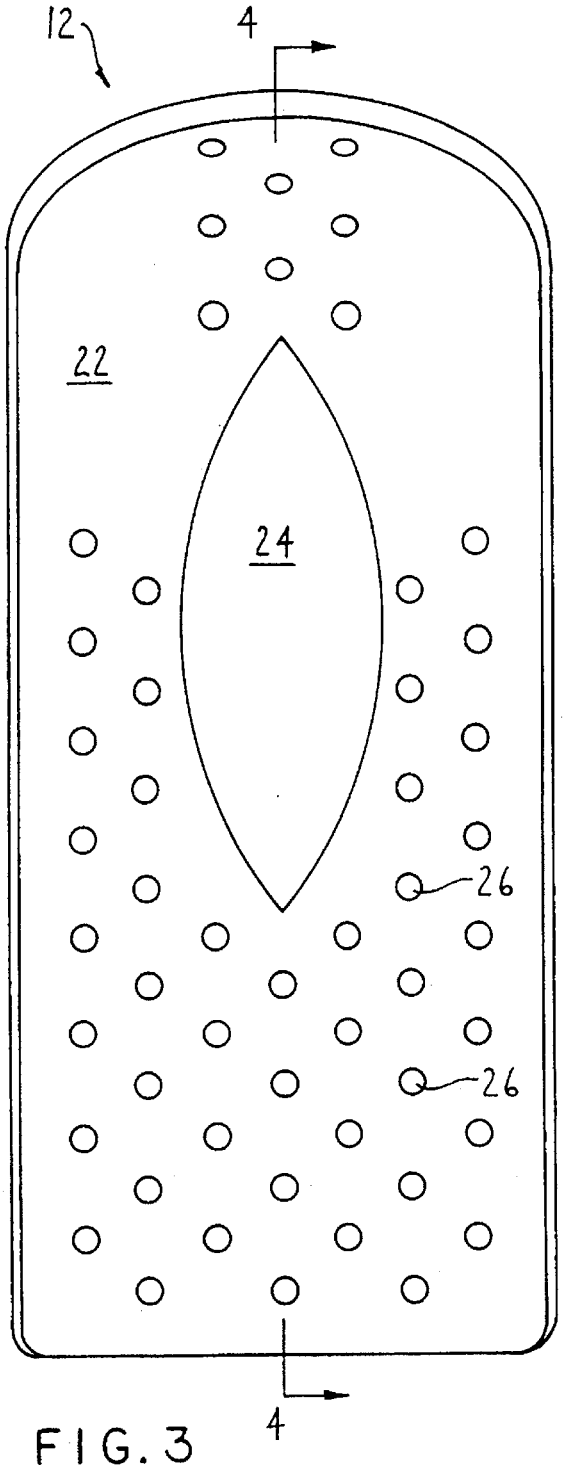
FIG. 3 is a rear plan view of the cushion subassembly of the protective body pad of FIG. 1.
Figure 4:
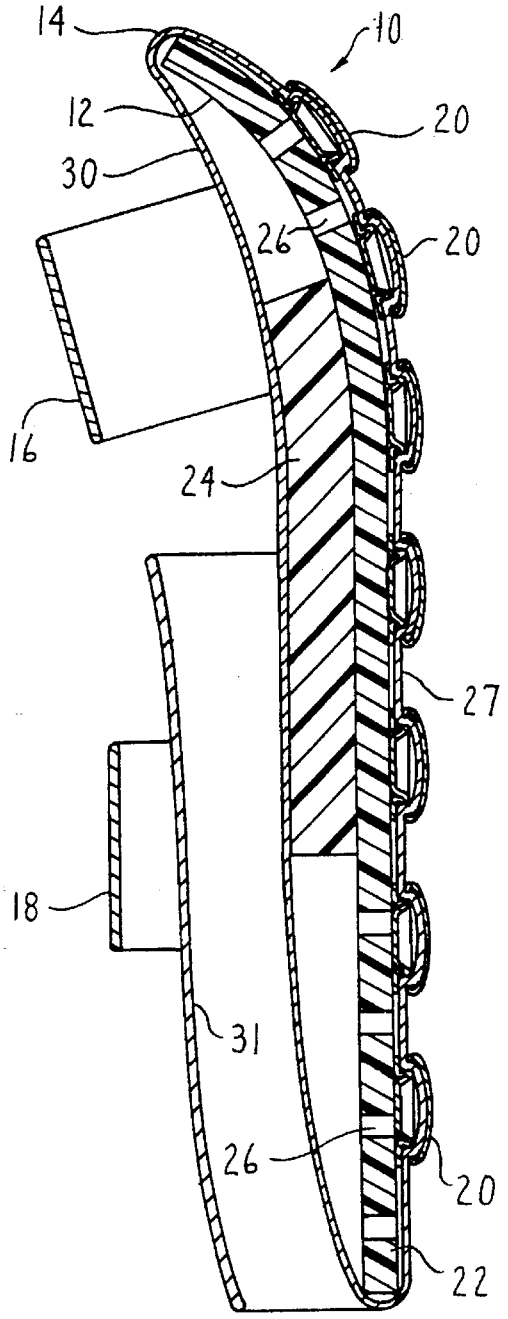
FIG. 4 is a cross-sectional view of the protective body pad of FIG. 1.

FIGS. 1–4 illustrate a protective body pad 10 of this invention that is configured to be worn on the knee and adjacent upper calf of an individual. The protective body pad 10 includes a cushion sub-assembly 12 that is disposed inside a fabric shell 14 that is secured to the knee and calf. Shell 14 is provided with a pair of straps 16 and 18 to facilitate securing the pad 10 to the knee and calf. A set of caps 20 are secured to the outer surface of the shell 14 to absorb and deflect hard surface shock to which the protective pad 10 can be exposed.

Cushion sub-assembly 12 includes an outer cushion 22 and an inner cushion 24. The outer cushion 22 is formed out of a relatively large section of foam cushioning material and is shaped to conform to the profile of the knee and upper calf. Outer cushion 22 is .formed out of a relatively incompressible, rapidly rebounding foam material. In one preferred version of the invention, outer cushion 22 is formed out of an ethylene vinyl acetate foam layer that is approximately 0.325 inches thick and is marketed by the Rubatex Corporation of Bedford, Va. as Stock No. R-5010-A. This particular foam has a density of approximately 1.5 to 2.5 pcf and a compression deflection of approximately 2 to 5 psi. This particular material is shaped to conform to the adjacent body parts by cutting triangularly shaped, laterally extending slices from a flat section of foam. The surfaces formed by the slice removal are then glued together to provide the material with a selectively curved profile. At locations spaced away from the inner cushion member 24, the outer cushioning member 22 is formed with a number of spaced apart through bores 26. These through bores have a diameter between 0.15 and 0.40 inches, and more preferred embodiments of the invention have a diameter of 0.25 inches.

The inner cushion 24 is glued or otherwise secured to the inner surface of the outer cushioning member 22. The inner cushion 24 is relatively small sized. In the depicted version of the invention, inner cushion 24 has a symmetrically shaped, curved wedge profile. Inner cushion 24 is secured to the outer cushioning member so as to be located adjacent the portion of the body that would most likely be the initial point of impact for any physical shock. For example, the depicted body pad 10 is shaped to be worn over the knee and upper calf so that the inner cushion 24 is located adjacent the upper end of the tibia 64 as seen by reference to FIG. 7. Inner cushion 24 is formed of relatively compressible, slowly rebounding foam. In one preferred version of the invention, inner cushion 24 is formed out of a 0.70 inch thick section of a diphenylmethane diisocyanate (MDI) foam marketed by the Flexible Products Company of Marietta, Ga. as product FP156. This foam has a compression deflection of approximately 1 to 2 psi and a density of 0.6 to 0.8, pfc. Glue such as a water based contact cement is used to bond the inner cushioning member 24 to the outer cushioning member 22.

Figure 6:
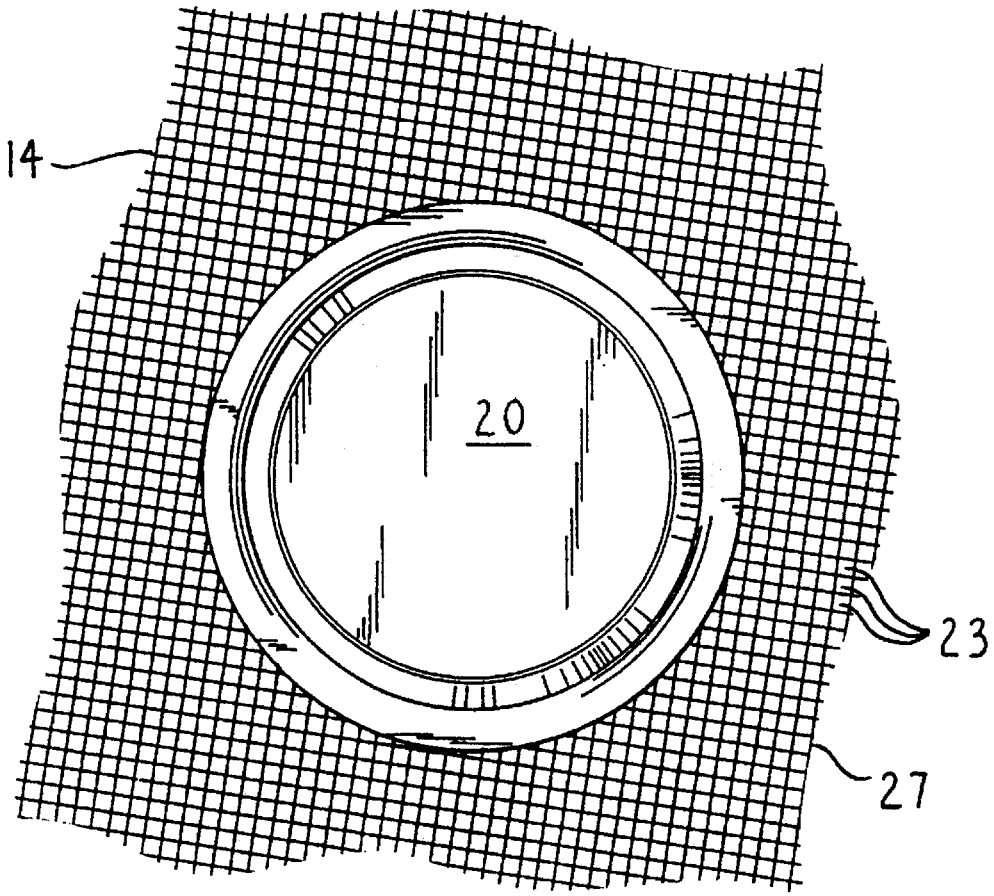
FIG. 6 is a front plan view of a preferred metal cap of the protective body pad of this invention.

Shell 14 holds cushion sub-assembly 12 against the knee and upper calf. Shell 14 formed from a fabric 27 formed out of either natural or man-made fibers that are woven to form openings 23 (FIG. 6) between the individual fabric threads. In one preferred version of the invention, shell 14 is formed out of a fabric 27 that is a blend of 80% cotton, 14% nylon and 6% Spandex elastic polyurethane polymer. Two sections of fabric forming the shell 14 are woven together to form a body 30 in which the cushion sub-assembly is actually seated.

A first strap, strap 16, extends laterally across the top of the shell body 30 to wrap around the inside of the knee of the individual. A second strap, strap 18, is actually formed out of two Sections **19*a* and 19*b*, that are positioned to extend across the back side of the individual's calf. Strap sections 19*a* and 19*b* are provided with complementary adjustable fastening members (not illustrated), for securing the strap 10 to the calf. In the depicted version of the invention, the fastening members are complementary strips of Velcro hook-and-pile fastening tape. Shell 14 is further constructed so as to have a sleeve 31 that extends from approximately the mid-level of the shell body 30 down to the bottom of the body. Sleeve 31 is formed out of the same material from which the shell body 30 is formed. When an individual slips the body pad into position, his upper calf is located between the shell body 30 and the sleeve and strap 18 is located around the outside of the sleeve 31**.

The metal caps 20 are secured to the outer face of the shell body 30. In preferred versions of the invention, caps 20 have a circular profile and a diameter of between 0.75 and 1.50 inches. In more preferred versions of the invention, caps 20 have a diameter of between 1.0 and 1.15 inches. Each cap 20 is formed to have a convex or outwardly curved profile so as to have an overall rise from base to apex of approximately 0.15 to 0.25 inches. Each cap 30 is further formed with an inwardly directed rim 52 that extends around the inside perimeter of the cap. The metal forming the cap rim 52 is further formed so as to have spaced apart upwardly directed, outwardly curved teeth 54 along the upper edge of the rim.

Figure 5:
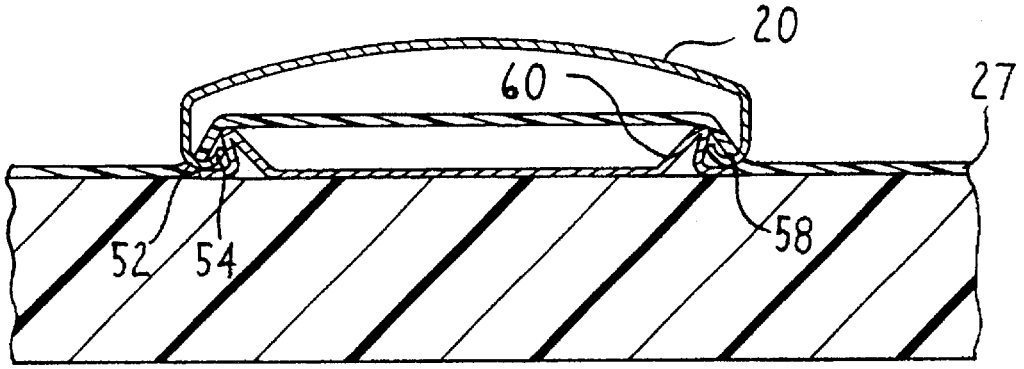
FIG. 5 is a detailed cross-sectional view illustrating how a metal cap is secured to the outer shell of the protective body pad of this invention.

Each cap 20 is secured to the shell 14 by a disk 58 (FIG. 5) located between the outer cushion member 22 and the shell fabric 27. Each disk 58 is shaped to have a diameter that approximately corresponds to that of the associated cap 20. Each disk 58 is further formed with an upwardly extending, outwardly directed collar 60. Each cap collar 60 is dimensioned to fit inside cap 20 so as to closely abut adjacent cap rim 56. A cap 20 is secured to the shell 14 by first locating the cap in a desired position on the shell body 30. Once the cap is properly positioned, the complimentary disk 58 is located on opposed sides of the fabric forming the shell body 30. The locking disk 58 is then pressed toward the cap so as to cause the fabric between the cap and disk to double back and become compression secured between the cap and locking disk. Furthermore, owing to the outwardly curved profile of the collar 60, the action of compressing the cap down over the disk causes the cap rim teeth 54 to penetrate the shell fabric 27 so as to further hold the cap in position.

Figure 7:
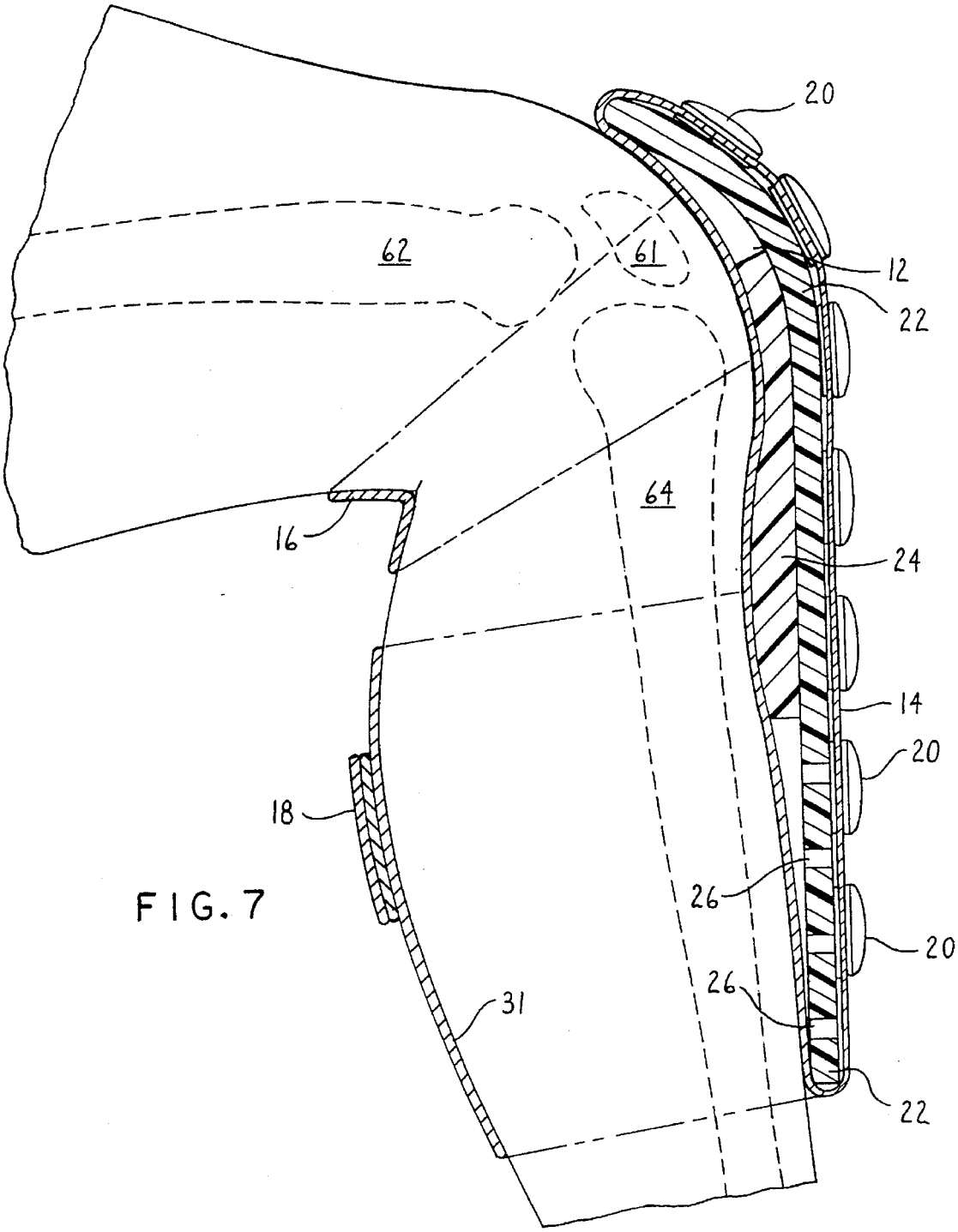
FIG. 7 depicts how the protective body pad of FIG. 1 is worn to protect the knee and leg of an individual.
Figure 10:
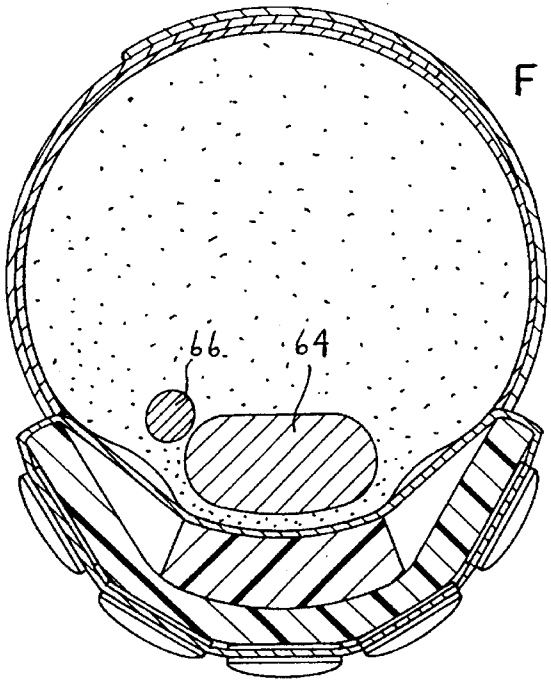
FIG. 10 is a lateral cross-sectional view of how the protective body pad of this invention protects the knee and adjacent leg.
Figure 9:
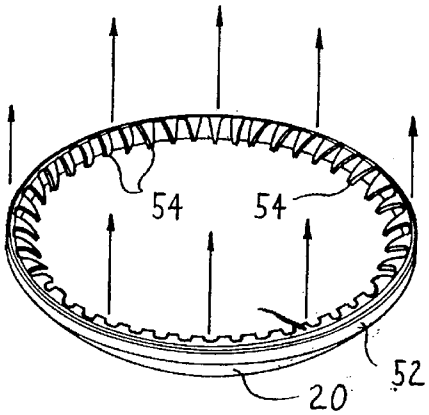
FIG. 9 is a bottom view of the metal cap.

As represented by FIG. 7, once the protective body pad 10 of this invention is slipped onto the wearer's leg, the upper portion of the pad is held in position adjacent the individual's knee joint by the knee strap 16, the lower portion of the pad is held in position by the sleeve 31 and strap 18. As seen by FIGS. 7 and 10, when the body pad 10 is strapped on, it covers the patella 61, the lower femur 62, the upper tibia 64, the upper fibula 66, and the soft tissue surrounding these bones.

During normal wear of the body pad 10, the inner cushion 24, holds the adjacent section of the outer cushion 22 a slight distance away from the body of the individual. The porous nature of the shell fabric 27, the shell 14 and the bores 26 formed in the outer cushion 22 permit air flow through the body pad and around the adjacent skin. Collectively, these features of the invention foster the evaporation of perspiration away from the covered skin and allow convection cooling of the skin. The combined cooling effects of the perspiration evaporation and the convective air flow substantially reduce any sweaty, uncomfortable feeling an individual might otherwise develop while wearing the body pad 10 against his body.

Figure 8:
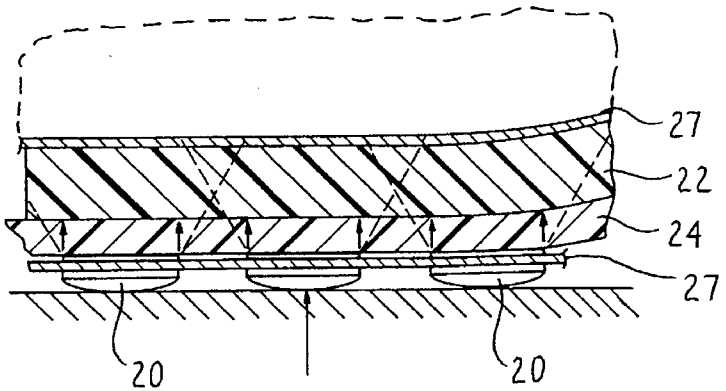
FIG. 8 illustrates how the shock of striking a hard surface is distributed throughout the protective body pad of this invention.

In the event the individual wearing the protective body pad 10 strikes a hard object, such as piece of pavement, the shock-reducing features of the pad immediately take effect. Some of the shock is initially absorbed by the metal caps 20. Furthermore, since the caps are spaced apart and formed with convex surfaces, the caps do not simply lock the pad into the hard surface. Instead, the caps 20 allow the pad to skid along the object so that a fraction of the impact induced force is converted into friction heat. Moreover, any force not absorbed or redirected by the caps 20 is transmitted through the caps around their outer perimeter surfaces as depicted in FIG. 8. The redistribution of this force diminishes its harmful effects. The effects of these impact forces are, of course, further reduced by the fact that they are then absorbed into the adjacent foam forming the outer cushion 22.

Simultaneously with the shock damping effects of the cap 20, a further fraction of the shock force is absorbed by the compression of the cushion sub-assembly 12. Initially, much of this shock damping is in the form of the dissipation of the force into the compression of the inner cushion 24. Additional energy absorption then occurs as the outer cushion 22 is forced into compression. Thus, owing to the combined force absorbing and redirecting characteristics of the cushion sub-assembly 12 and the caps 20, the protective body pad 10 of this invention diverts impact forces away from the adjacent body parts where they can damage both hard and soft body tissue.

Still another feature of the protective body pad 10 of this invention is that the caps are secured to the shell fabric 27 around the outer perimeters of the caps. Consequently, when the caps 20 are subjected to an impact force, they transmit the force through the whole of their perimeters to the underlying fabric 27. The circumferential distribution of this force substantially eliminates the likelihood that a large force vector will cause a cap 20 to separate from the shell 14. Thus the single or repetitive exposure of the protective body pad of this invention should not cause its utility to diminish due to component failure.

Figure 11:
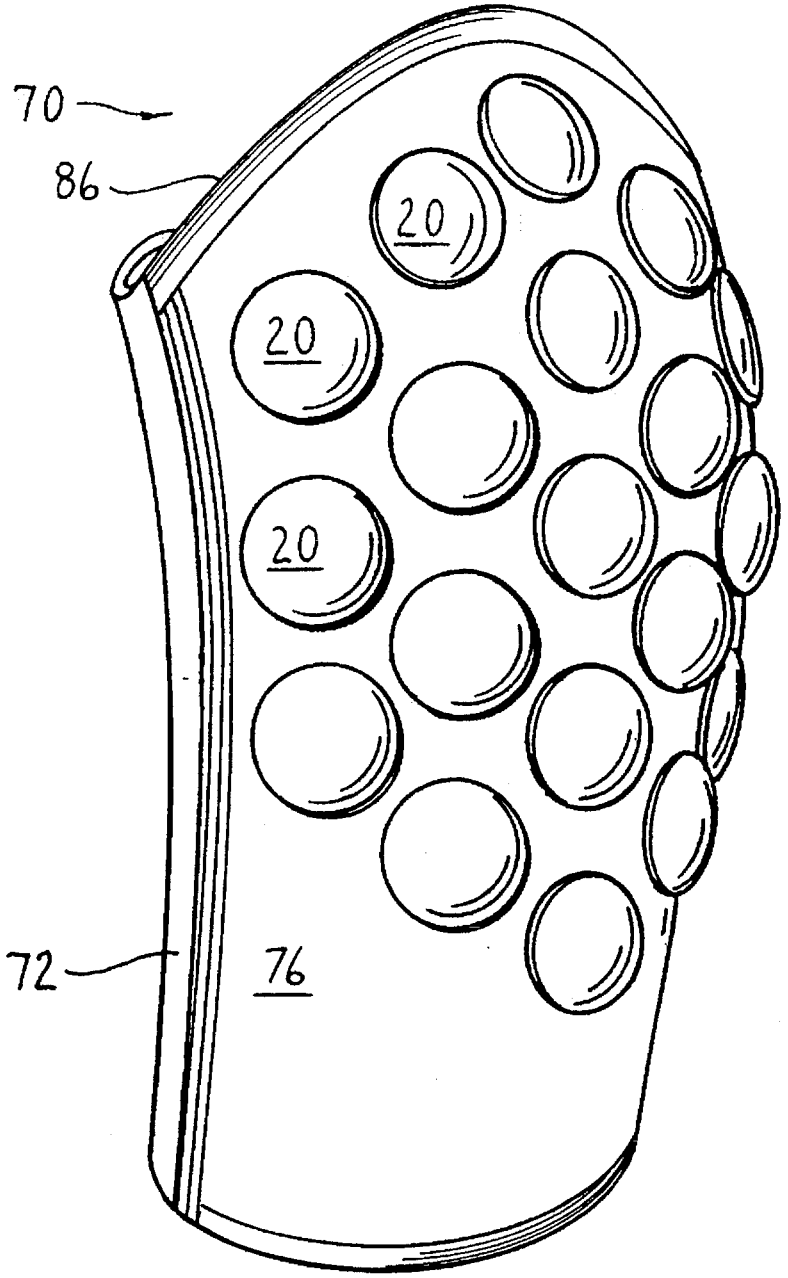
FIG. 11 is a perspective view of an elbow pad constructed according to this invention.
Figure 12:
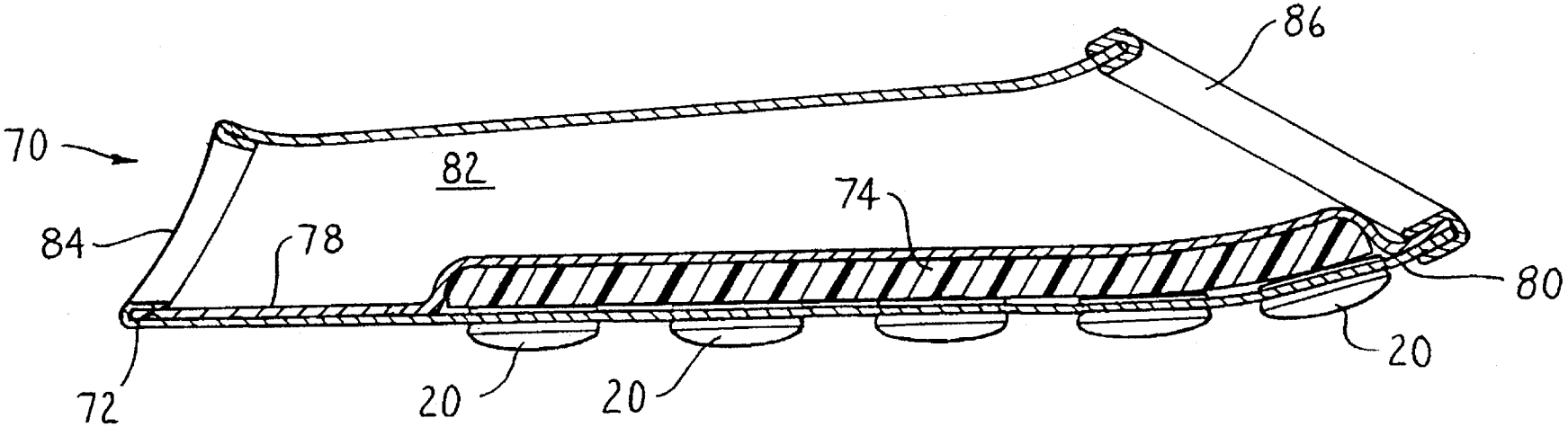
FIG. 12 is a cross-sectional view of the elbow pad of FIG. 11.

FIGS. 11 and 12 illustrate a protective body pad 70 of this invention dimensioned to be worn around the elbow of the individual. Protective body pad 70 includes a fabric shell 72 in which a single relatively incompressible, rapidly rebounding foam pad 74 is housed. Not shown in this version of the invention are the bores that extend through foam pad 74. A set of metal caps 20 are secured to the outer surface of the shell 72.

Shell 72 is formed out of three sections of fabric that are stitched together. An outer panel 76 forms the outer face of the shell 72. An inner panel 78 is attached directly over the outer panel 76 to form a sealed pocket 80 in which the foam pad 74 is seated. A wrap panel 82 extends relatively loosely over the inner panel 78 to form a closed sleeve 84 with the outer panel 76-inner panel 78 sub-assembly that is fitted around the elbow of a person wearing the pad 70. An elastic band 86 is attached to one or both ends of the sleeve to ensure that the pad stays in position around the arm of the individual.

The above detailed description has been limited to specific embodiments of the invention. It will be apparent, however, that variations and modifications can be made to this invention with the attainment of some or all of the advantages thereof. For example, there is no need that each version of this invention be provided with a cushion sub-assembly formed out of the outer and inner cushions of two different types of cushioning materials. Similarly, in some versions of the invention it may not be necessary to attach the disclosed metal caps to the outer surface of the shell 14.

It should also be recognized that the components of this invention may be fabricated from material different from the material disclosed herein. Similarly, the components forming the invention may have different shapes than what has been disclosed. For example, it may be desirable to form the shell 14 of this invention so that the body pocket can be selectively accessible. This would allow one to change or replace the type of cushion sub-assembly installed in the pad 10 in order to adjust for different activities in which the user might be engaged in or to simply replace the cushions if they become worn. Moreover, while in the disclosed embodiments of the invention, the caps 20 have a circular profile, in other versions of the invention, depending on the particular activity for which a particular pad 10 is designed, the caps may have other shapes. Furthermore, in some versions of the invention caps of different shapes may be attached to the shell 14 in order to absorb and redirect different types of impact forces to which the pad 10 may be exposed. Also, devices other than the disks 58 may be employed to secure the caps to the fabric forming the shell outer surface. Furthermore, other versions of the invention may have different constructions than what has been described. For example, it may be desirable to provide a knee pad of this invention with two adjustable length straps that facilitate securing the pad to the leg. These versions of the invention may not need the previously described sleeve 31. Furthermore, it may be desirable to provide elbow-arm pads of this invention with one or more adjustable length straps that facilitate securing the pads to the arms of individuals that avail themselves of the protection this invention offers.

Moreover, while the invention has been described for use by roller skaters, it should be understood that individuals engaged in other activities, such as roofers, may find it a preferable protective design for comfortably reducing the shock of physical impact.

Thus, although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A protective body pad for attachment to a body limb, said body pad including;

a shell formed of porous material, said shell having an outer surface;

a strap secured to said shell for releasably attaching said shell to the body limb;

a cushion sub-assembly disposed in said shell; and a plurality of metal caps attached to said shell outer surface, each said metal cap having a center and being attached to said shell by a fastening mechanism that secures said cap to said shell material at a plurality of locations spaced from said cap center.

2. The protective body pad of claim 1, wherein said cushion sub-assembly includes a first, outer cushion formed of a first material having a compressibility, said first cushion being shaped to substantially fill said shell and a second cushion attached to said first cushion formed of a second material that is more compressible than said material forming said first cushion, said second cushion being dimensioned to be smaller in size than said first cushion and said cushions are arranged in said shell so that said second cushion is located adjacent the body and said first cushion extends over said second cushion.

3. The protective body pad of claim 2, wherein said first cushion has at least one section that extends away from said second cushion and said first cushion section that extends away from said second cushion is formed with a plurality of bores that extend therethrough.

4. The protective body pad of claim 2, wherein said shell is formed from a woven fabric wherein interstitial spaces between fibers in said woven material define a plurality of pores through said fabric.

5. The protective body pad of claim 2, wherein each said cap has an outer perimeter and is secured to said shell material by a fastening mechanism located substantially circumferentially around said cap outer perimeter.

6. The protective body pad of claim 5, wherein each said cap is formed with an internal rim that extends around said outer perimeter of said cap and said cap is secured to said shell material by a securement disk located in said shell, said securement disk including a collar that is positioned to abut said cap internal rim so as to secure said shell material between said cap and said disk.

7. The protective body pad of claim 6, wherein said cap internal rim is formed with teeth positioned to engage said shell material.

8. The protective body pad of claim 5, wherein at least one said cap has a circular cross-sectional profile.

9. The protective body pad of claim 2, further including a sleeve formed of porous material attached to said shell, said sleeve being dimensioned to facilitate the placement of said shell around the body limb, and an adjustable strap attached to said shell across the outside of said sleeve for releasably securing said shell to the body limb.

10. The protective body pad of claim 1, wherein each said cap has an outer perimeter and is secured to said shell material by a fastening mechanism located substantially circumferentially around said cap outer perimeter.

11. The protective body pad of claim 10, wherein each said cap is formed with an internal rim that extends around said outer perimeter of said cap and each said cap is secured to said shell material by a securement disk located in said shell, each said securement disk including a collar that is positioned to abut said cap internal rim so as to secure said shell material between said cap and said securement disk.

12. The protective body pad of claim 11, wherein said cap internal rim is formed with teeth positioned to engage said shell material.

13. The protective body pad of claim 11, wherein at least one said cap has a circular cross-sectional profile.

14. The protective body pad of claim 10, further including a sleeve formed of porous material attached to said shell, said sleeve being dimensioned to facilitate the placement of said shell around a body part, and an adjustable strap attached to said shell across the outside of said sleeve for releasably securing said shell to the body part.

15. A protective body pad for attachment to a body limb, said body pad including:

a shell formed of porous material, said shell having an outer surface;

a strap secured to said shell for releasably attaching said shell to the body limb;

a cushion sub-assembly disposed in said shell, said cushion sub-assembly including a first, outer cushion formed of a first material having a compressibility, said first cushion being shaped to substantially fill said shell and a second cushion attached to said first cushion, said second cushion being formed of a material that is more compressible than said material forming said first cushion and said second cushion being dimensioned to be smaller in size than said first cushion and said cushions are arranged in said shell so that said second cushion is located adjacent the body and said first cushion extends over said second cushion; and a plurality of spaced-apart metal caps attached to said shell outer surface, each said metal cap having a center and being attached to said shell by a fastening mechanism that secures said cap to said shell material at a plurality of locations spaced from said cap center.

16. The protective body pad of claim 15, wherein said first cushion has at least one section that extends away from said second cushion and said first cushion section that extends away from said second cushion is formed with a plurality of bores that extend therethrough.

17. The protective body pad of claim 15, wherein said shell is formed from a woven fabric wherein interstitial spaces between fibers in said woven material define a plurality of pores through said fabric.

18. A protective body pad for attachment to a body limb, said body pad including;

a shell formed of porous material, said shell having an outer surface;

a sleeve secured to said shell for holding said shell to the body limb;

a cushion sub-assembly disposed in said shell; and a plurality of metal caps attached to said shell outer surface, each said metal cap having a center and being attached to said shell by a fastening mechanism that secures said cap to said shell material at a plurality of locations spaced from said cap center.

19. A protective body pad of claim 18 further including an adjustable strap secured to said shell for further securing said shell to the body limb.

20. The protective body pad of claim 18, wherein said cushion sub-assembly includes a first, outer cushion formed of a first material having a compressibility, said first cushion being shaped to substantially fill said shell and a second cushion attached to said first cushion formed of a second material that is more compressible than said material forming said first cushion, said second cushion being dimensioned to be smaller in size than said first cushion and said cushions are arranged in said shell so that said second cushion is located adjacent the body and said first cushion extends over said second cushion.

21. The protective body pad of claim 18, wherein each said cap has an outer perimeter and is secured to said shell material by a fastening mechanism located substantially circumferentially around said cap outer perimeter.

22. The protective body pad of claim 21, wherein each said cap is formed with an internal rim that extends around said outer perimeter of said cap and each said cap is secured to said shell material by a securement disk located in said shell, each said securement disk including a collar that is positioned to abut said cap internal rim so as to secure said shell material between said cap and said securement disk.

* * * * *